United States Patent [19]

Schmidt

[11] Patent Number: 4,620,638

[45] Date of Patent: Nov. 4, 1986

[54] CAP FOR OPENING AND EXTRACTING THE CONTENTS OF A VESSEL

[75] Inventor: Manfred Schmidt, Rosbach, Fed. Rep. of Germany

[73] Assignee: Milupa Aktiengesellschaft, Friedrichsdorf, Fed. Rep. of Germany

[21] Appl. No.: 657,198

[22] Filed: Oct. 3, 1984

[30] Foreign Application Priority Data

Oct. 7, 1983 [DE] Fed. Rep. of Germany ..... 3336612

[51] Int. Cl.[4] ..... B65D 1/02

[52] U.S. Cl. ..... 215/11 R; 215/32; 215/256

[58] Field of Search ..... 215/11 R, 11 C, 32, 215/228, 256, 252

[56] References Cited

U.S. PATENT DOCUMENTS

| | | | |
|---|---|---|---|
| 3,146,904 | 9/1964 | Hansen | 215/11 |
| 3,266,910 | 8/1966 | Barnby | 99/171 |
| 3,519,157 | 7/1970 | Meierhoefer | 215/11 |
| 4,053,648 | 10/1977 | Schmid et al. | 215/11 R X |
| 4,101,041 | 7/1978 | Mauro, Jr. et al. | 215/32 X |
| 4,176,755 | 12/1979 | Winchell | 215/32 |
| 4,307,821 | 12/1981 | McIntosh | 215/256 |
| 4,378,891 | 4/1983 | Fowles et al. | 215/32 |
| 4,402,415 | 9/1983 | Hopley | 215/32 |
| 4,405,053 | 9/1983 | Cherot | 215/32 |
| 4,412,623 | 11/1983 | Schmidt | 215/11 R |
| 4,458,818 | 7/1984 | Hansen | 215/32 |
| 4,526,279 | 7/1985 | Weiler et al. | 215/32 |

FOREIGN PATENT DOCUMENTS

| | | | |
|---|---|---|---|
| 2332155 | 1/1975 | Fed. Rep. of Germany | 215/32 |
| 2358128 | 9/1975 | Fed. Rep. of Germany . | |
| 2545128 | 4/1976 | Fed. Rep. of Germany . | |
| 2136603 | 12/1972 | France . | |
| 2287243 | 5/1976 | France . | |
| 497894 | 12/1970 | Switzerland . | |

*Primary Examiner*—Steven M. Pollard

*Attorney, Agent, or Firm*—Bernard, Rothwell & Brown

[57] ABSTRACT

A cap for opening and extracting the contents of a vessel provided with a neck and an extraction end closed by a removable attachment connected to the vessel neck by a weakened zone, the cap having an open end for engagement over the vessel neck whereby rotation of the cap relative to the vessel neck causes the attachment to be separated from the vessel neck at the weakened zone so that the contents of the vessel may be removed through an extraction opening in the cap.

13 Claims, 8 Drawing Figures

CAP FOR OPENING AND EXTRACTING THE CONTENTS OF A VESSEL

BACKGROUND OF THE INVENTION

This invention relates to an opening and extraction cap, especially comprising a baby feeding teat or spoon, for a vessel having an extraction end closed by means of an attachment connected by a zone of weakness with the region of the extraction location at the bottle neck of the vessel, wherein the cap can be pushed with its open end over the bottle neck.

Liquid or pasty baby food, such as baby milk, is treated in a completely sterile manner during filling of same into bottles, especially disposable plastic bottles.

SUMMARY OF THE INVENTION

It is an object of the invention to provide an opening and extraction cap, especially for vessels or bottles filled in sterile manner and having a sterile content, which shall make possible the complete and sterile dispensing of the vessel contents, the device being highly economical to manufacture and easy to operate.

Accordingly, the opening and extraction cap of this invention is characterized in that it possesses, at the end of its internal space remote from the open end, at least one profile element defining a seating opening for receiving the attachment and separating same at its zone of weakness from the bottle neck, when the cap is rotated relative to the bottle neck. The closed end of the cap is provided with an extraction opening, at which the separated attachment is retained in the internal space of the cap between cap and vessel or its bottle neck and a sealing connection is provided. Means for securing the cap on the bottle neck, such as threading, are provided on at least a part of the wall region of the cap extending over the bottle neck. The sealing connection may also comprise a liquid-tight construction of the surfaces of the cap bearing against the upper face of the bottle neck.

A combination of features of this type can be particularly used when the attachment is a crossbar extending transversely to the longitudinal axis of the vessel, which crossbar, especially where the material of the zone of weakness is plastics material, can be twisted off at the zone of weakness by a profile element or elements defining the seating opening when the cap is rotated relative to the bottle neck.

It is moreover advantageous if the means for securing the cap on the bottle neck include thread-like profiles, disposed on the outer face of the bottle neck, with corresponding threading on the inner face of the wall region of the cap extending over the bottle neck. The securing of the cap can also be realized in another manner, for example by means of a spring clip, or by profile elements which deform the wall of the plastic bottle.

An important simplification of the handling and prevention of unintentional opening during transportation and storage of the vessel is achieved if arresting means are provided between the region of the inner edge of the open end of the cap and the upper edge of the bottle neck for holding the attachment out of engagement with the profile elements when the cap is placed onto the bottle neck. Such arresting means may include holding profiles of a wide variety of types or also an adhesive tape secured externally over the edge of the cap at the bottle neck.

An especially preferred embodiment of a sterile opening and extraction cap according to the invention comprises a cap which can be screwed onto the external profile on the bottle neck and which possesses, on its inner wall, an internal thread fitting onto the external profile on the bottle neck and also, at its end remote from the bottle neck, an opening having an extraction device connected therewith in liquid-tight manner. A cylindrical abutment element is disposed, inside the cap and which can be screwed into the inside of the cap by means of a thread-like profile provided on its external surface and a corresponding thread provided on the inner face of the cap. The abutment element possesses an internal a through aperture extending in the direction of its longitudinal axis, which aperture is widened out at the end nearest the bottle to the seating opening receiving the zone-of-weakness attachment, in which opening the zone-of-weakness attachment is retained in the transverse direction. Also, a seal is provided between the upper face of the bottle neck and the lower face of the abutment element for assuring a relative rotational capability between the abutment element and the upper face of the bottle neck when the abutment element is fully screwed into the cap.

For this purpose, the seating opening receiving the zone-of-weakness attachment may be cruciform in cross-section, and therefore provides more than one seating position of the zone-for-weakness attachment.

The advantages achieved with the opening and extraction cap according to this invention lie furthermore in a reduction of the bottle headroom, which also eliminates wastage of bottles due to compression during vacuum packaging. There is also realized a reduction of the material weight of the bottles, of the labour costs due to simplified assembly involving fewer parts, of the costs of materials and component parts of the cap, of the transportation and processing volume, and of reduced accuracy in manufacture of the individual parts. Furthermore, labelling is also simplified.

Moreover, the retaining of the baby feeding teat on the bottle is improved, because its sealing flange is firmly compressed between the edge of the upper face of the abutment element and the inner face of the cap. Also, inserted sieves can be eliminated, because no plastic chips are produced, a disadvantage realized with the use of cutting devices inside the cap.

Overall, the opening and extraction cap according to this invention also requires less force to use, and due to the lower stress in the material of the cap, bursting of the cap no longer occurs, since forced closure or pressed connection during assembly is not necessary.

Although the aforementioned forms of embodiment of the opening and extraction cap of this invention are particularly advantageous for vessel and bottle contents which are filled in sterile manner and correspondingly also should be extracted in sterile manner, such as baby milk dispensed through a teat or preserved blood etc., they are also advantageous for use when a liquid-tight handling of, for example, liquids which must be handled with care, such as acids or other aggressive liquids, is required.

The invention shall now be described in more detail with respect to several embodiments thereof and with reference to the drawings.

DETAILED DESCRIPTION OF THE PREFERRED EMBODIMENTS

Figure 1A:
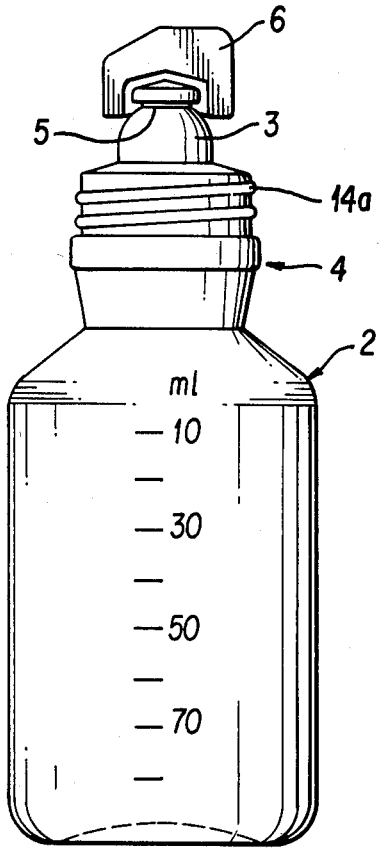
FIGS. 1*a* and 1*b* are a side view and plan of a known bottle of plastic material, closed in sterile manner and having a zone of weakness.
Figure 1B:
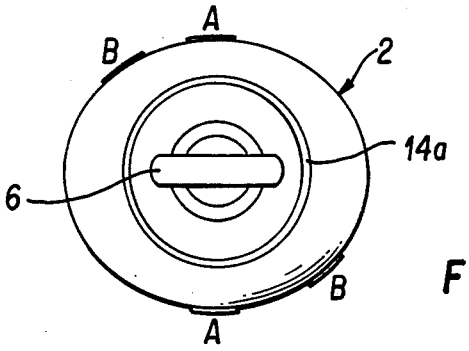

A vessel 2, illustrated in FIGS. 1*a* and 1*b*, having the form of a bottle for example a baby milk bottle, is provided on the outer face of its neck 4 a thread-like profile 14*a* and, at its extraction end 3, with a zone of weakness 5 and a bar-like attachment 6. If the bar-like attachment 6 is rotated relative to the bottle, the zone of weakness breaks and the bar-like attachment 6 is twisted off, exposing an outlet opening for the content of the bottle. The vessel 2 is preferably moulded from plastic material, in such a way that its contents may be filled in a completely sterile manner.

Figure 2:
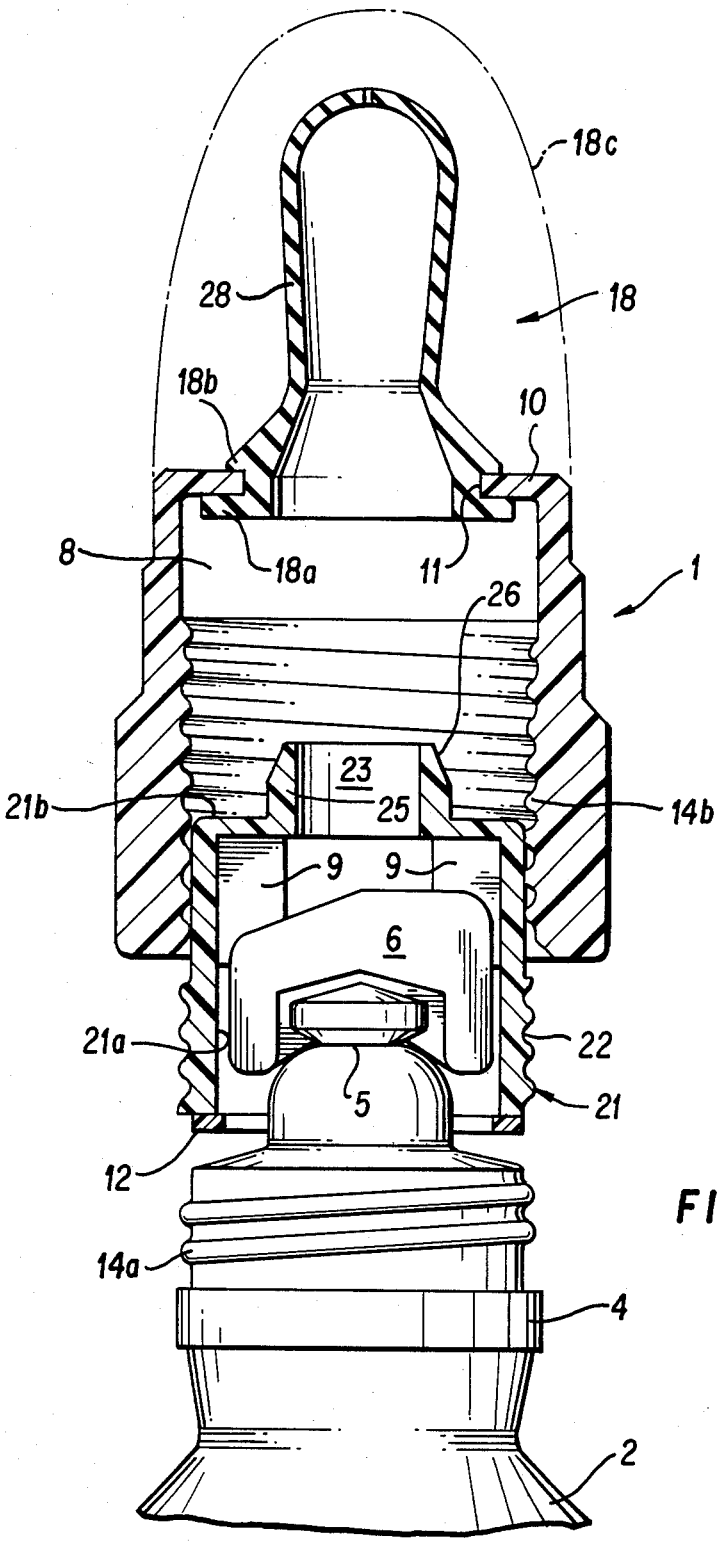
FIG. 2 is a preferred embodiment of an opening and extraction cap according to this invention having a baby feeding teat, shown in cross-section and partly extended.
Figure 3:
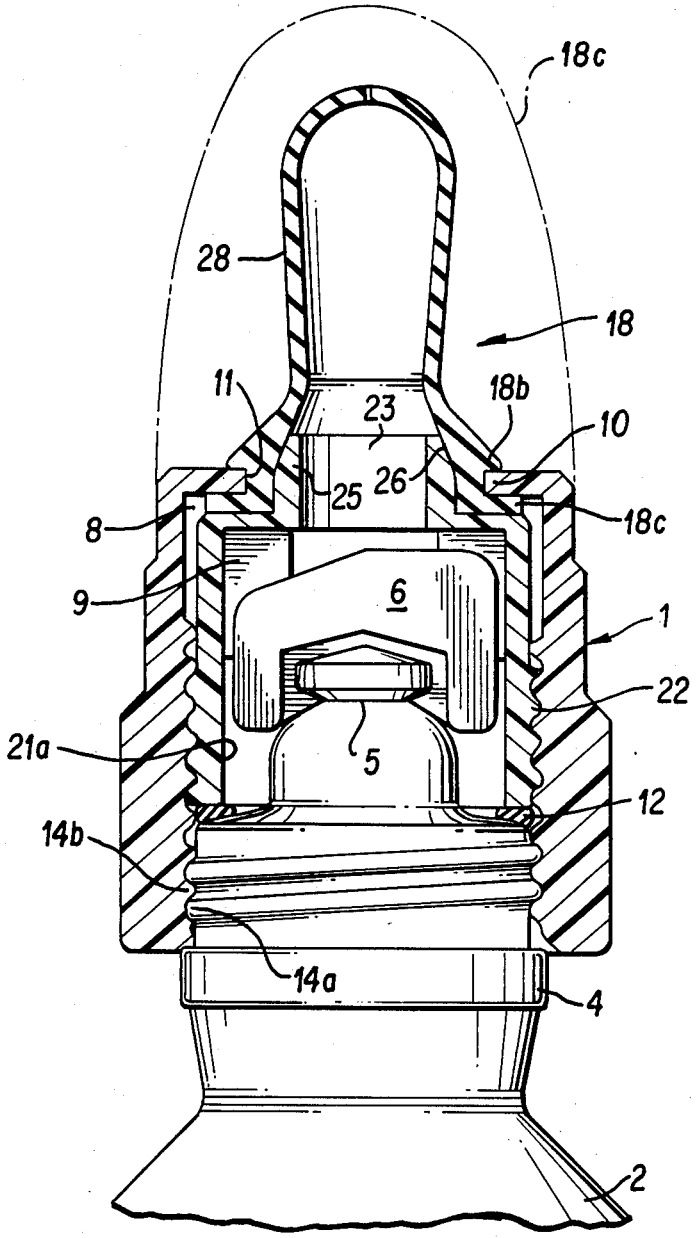
FIG. 3 is the cap according to FIG. 2, but in the screwed-in condition.

For the sterile extraction of the vessel contents, an opening and extraction cap 1, for example having the form of construction illustrated in FIGS. 2 and 3, is screwed onto the thread-like profile 14*a* and onto the bottle neck 4 of the vessel 2 in such a way that the internal space 8 of the cap is closed under sterile conditions if, by means of profile elements 9 inside the internal space 8 of the cap 1, the attachment 6 is twisted off from the upper face of the bottle neck 4 of the vessel 2 at its zone of weakness 5.

For this purpose, the cap 1 is provided with a cylindrical abutment element 21, which possesses in its interior a seating opening 21*a*, into which the attachment 6 can be introduced when the cap 1 is screwed on. A through aperture 23, passing through the cylindrical abutment element 21, communicates with the internal space of the seating opening 21*a*. At least in the lower region of the cylindrical abutment element 21, a thread-like profile 22 is provided on its outer face, by means of which the cylindrical abutment element 21 can be screwed into a corresponding thread-like profile 14*b*, so that the cylindrical abutment element 21 with the attachment 6 or crossbar introduced into its seating opening 21*a*, can be screwed into the internal space 8 of the cap 1 until the upper face 21*b* strikes against the upper end 10 of the cap 1 and the movement of the cylindrical abutment element 21 is stopped in the internal space 8 of the cap 1 by this upper end 10 of the cap, with simultaneous compressing of the teat flange 18*a*.

In this upper end 10 of the cap 1, an extraction opening 11 is provided, which is connected in liquid-tight manner with an extraction device 18.

In the preferred example of embodiment illustrated in FIGS. 2 and 3, the extraction device 18 consists of a baby feeding teat or, for example, of a spout-like element for removing pasty contents from the vessel 1.

The baby feeding teat 28 is provided, at its open end, with a radially extending sealing flange 18*a*, which passes through the extraction opening 11 and bears on the inner face of the extraction end 3 of the cap 1, to form a seal. On the outer face of the extraction end 3, the baby feeding teat 28 possesses a sealing lip 18*b*. The teat 28 is protected on the cap 1 by means of a protective cap 18*c*, which is removably fixed to the upper face of the cap 1. Before the opening and extraction cap 1 is used, it is sterilized together with all the above-described individual parts, before being screwed onto the bottleneck 4 and its thread-like profile 14*a*. As soon as the cylindrical abutment element 21 engages its upper face 21*b*, against the sealing flange 18*a* of the feeding teat 28, the attachment 6 is twisted off at the zone of weakness 5 by a further rotational movement and the sterile contents of the vessel pass, via the through aperture 23, into the sterile internal space of the cap 1 and directly into the feeding teat and can now, after the protective cap 18*c* has been removed, be fed to the baby in the most sterile manner possible.

The lower face of the cylindrical abutment element 21 provides a tight sealing connection with the upper face of the bottle neck 4 by means of a seal 12 in the screwed-on state of the cap 1. An additional seal 12 may also be provided, which preferably is also axially compressible, in order to render additional axial movement when the cap 1 is screwed onto the bottle neck 4 in the sealed condition.

The attachment 6, twisted off during the opening operation, is larger than the through aperture 23, so that it remains inside the cap 1 while the contents are extracted.

On the upper face of the cylindrical abutment element 21, a tubular extension 25 may also be formed, for defining through aperture 23. Extension 25 may also be provided with a conically tapering end 26 for insertion into the internal space of the feeding teat 28. The seating opening 21*a* for receiving the attachment 6 can be of several configurations. For example it may be of cruciform shape as shown in FIG. 5*c*.

Figure 4:
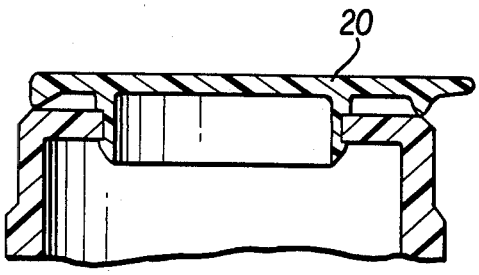
FIG. 4 shows in cross-section a flap closure of the cap of this invention.

The means described in the foregoing embodiment for securing the cap on the bottle neck, i.e. the threaded profiles 14*a* and 14*b*, may also be replaced by a spring clip 15. With extraction devices 18 of a different type, a closure lid 20, illustrated as an example in FIG. 4, is also possible.

Figure 5A:
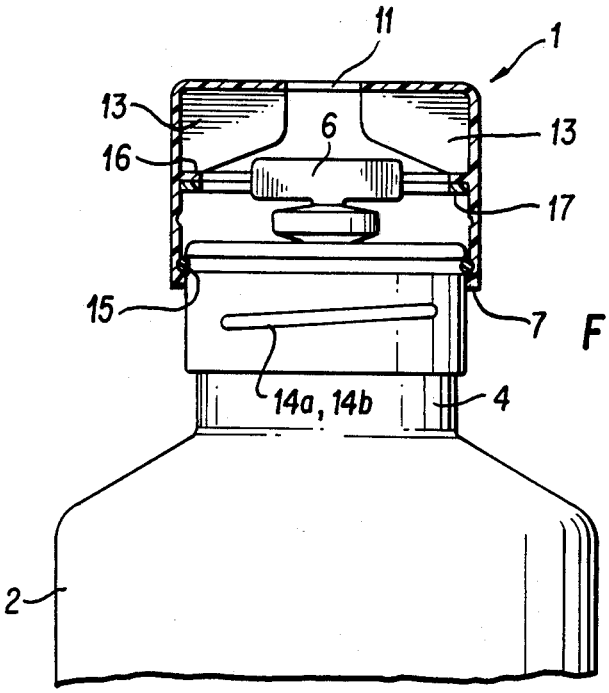
FIGS. 5*a*, 5*b* and 5*c* collectively depict another embodiment of the opening and extraction cap according to this invention in two different actuating positions, and in plan view.
Figure 5B:
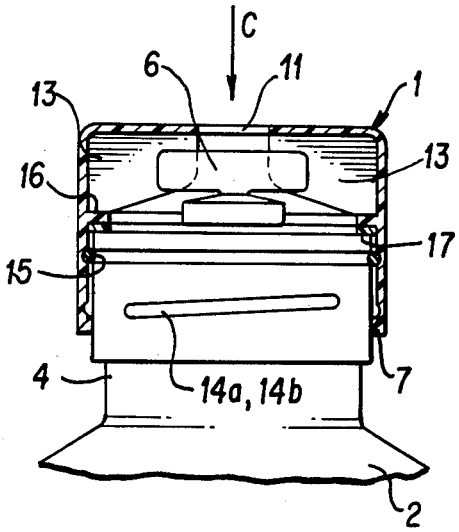
Figure 5C:
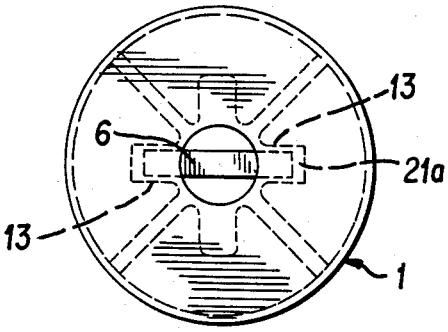

The simplified form of the opening and extraction cap 1 shown in FIGS. 5*a* to 5*c* is also not only for sterile liquids, but may be used in other applications as well. The retaining profile elements 15 are provided on the upper edge of the bottle neck 4, which elements maintain the cap 1, during transportation and storage, firmly on the bottle neck but which, by the exertion of a light axial pressure in the direction of arrow C in FIG. 5*b* in the manner of a snap connection, release the axial movement of the cap 1, so that this cap can be pushed onto the bottle neck 4. The attachment 6 then passes between the profile elements 13 and likewise may be twisted off by means of a short rotational movement at the end of the axial pushing-on movement, thus permitting the vessel contents to be freely dispensed through the extraction opening 11. At the end of the axial movement of the cap 1 according to FIGS. 5*a* and 5*c*, a seal 17 may likewise be disposed inside the cap 1, which seal is fixed to a circumferential stop 16 inside the cap 1 and against which the edge of the upper face of the bottle neck 4 is firmly pressed during the rotational movement.

The arresting devices 15 serve to prevent unintentional opening of the cap 1 and can also be provided in the embodiment shown in FIGS. 2 and 3.

The rotational movement performed at the end of the initial axial engagement of the cap, and by which the attachment 6 is simultaneously twisted off and the cap 1 is firmly screwed onto the bottle neck, can also be monitored by providing marks on the outer edge of the cap 1. Such marks are shown in FIG. 1*b* as A and B, and by which a three-quarters rotation, for example, can be accurately determined.

I claim:

1. A cap for opening and extracting the contents of a vessel provided with a neck and an extraction end closed by a removable attachment connected to the vessel neck by a weakened zone, and wherein the cap includes an open end for engagement over the vessel neck, which cap comprises:

(a) means disposed internally of the cap for engaging the attachment whereby rotation of the cap relative to the vessel neck causes the attachment to be separated from the vessel neck at the weakened zone and thereby open the vessel;

(b) an extraction opening through which the contents of the vessel may be removed after separation of the attachment from the vessel neck;

(c) means for detachably securing the cap onto the vessel neck; and (d) means for forming a seal with the vessel neck, wherein rotation of the cap to separate the attachment from the vessel and thereby open the vessel also forms said seal and forms a continuous path from the interior of the vessel to outside the cap through the extraction opening in the cap.

2. The cap of claim 1 wherein the means for detachably securing the cap onto the vessel neck includes threading formed on an internal wall surface of the cap corresponding to threading formed on an external surface of the vessel neck.

3. The cap of claim 1 wherein the attachment is in the configuration of a crossbar extending transversely to the longitudinal axis of the vessel and the means for engaging the attachment includes at least one profile element defining an opening having a corresponding configuration for receiving the crossbar.

4. The cap of claim 3 wherein the opening for receiving the crossbar is substantially in the form of a cruciform.

5. The cap of claim 1 further including a closure lid for the extraction opening.

6. The cap of claim 1 further including:

(a) a cylindrical abutment element detachably receivable within the cap;

(b) the means of engaging the attachment being disposed within the abutment element; and (c) the abutment element including an opening for communicating with the extraction opening for removing the contents of the vessel after separation of the attachment from the vessel neck.

7. The cap of claim 6 wherein the abutment element includes threading on its external surface and the cap includes corresponding threading on its internal surface for detachably securing the abutment element within the cap.

8. The cap of claim 6 wherein the opening in the abutment element is defined by a tubular extension which is disposable through the extraction opening when the abutment element is fully received within the cap.

9. The cap of claim 6 wherein said seal is formed by a seal means for sealing the abutment element to the vessel neck.

10. The cap of claim 9 wherein the seal means is axially compressible.

11. The cap of claim 6 further including a baby feeding teat secured to the extraction opening for dispensing the contents of the vessel.

12. The cap of claim 11 further including a protective cap for enclosing the baby feeding teat.

13. A cap for opening and extracting the contents of a vessel, the cap comprising:

(a) an open engaging end for engagment over a neck of a vessel, which neck includes an extraction end closed by a removable attachment connected to the vessel neck by a weakened zone;

(b) means for detachably securing said engaging end of said cap onto said vessel neck, the securing means including threading formed on an internal wall surface of the cap which corresponds to and is rotatably engageable with threading formed on an external surface of the vessel neck;

(c) means disposed internally of the cap for engaging the attachment, whereby rotation of the cap relative to the vessel neck causes the attachment to be separated from the vessel neck at the weakened zone and thereby open the vessel;

(d) an extraction opening through which contents of the vessel may be removed after separation of the attachment from the vessel neck; and (e) means for forming a seal with the vessel neck, wherein rotation of the cap relative to the vessel neck along the threading opens the vessel while forming said seal and while forming a continuous path from the interior of the vessel to outside the cap through the extraction opening in the cap.

* * * * *